US011423782B2

(12) United States Patent
Ashida et al.

(10) Patent No.: US 11,423,782 B2
(45) Date of Patent: Aug. 23, 2022

(54) TRAFFIC STATUS ESTIMATION DEVICE, TRAFFIC STATUS ESTIMATION METHOD, AND PROGRAM RECORDING MEDIUM

(71) Applicant: NEC Corporation, Tokyo (JP)

(72) Inventors: Yuta Ashida, Tokyo (JP); Itaru Nishioka, Tokyo (JP)

(73) Assignee: NEC CORPORATION, Tokyo (JP)

( * ) Notice: Subject to any disclaimer, the term of this patent is extended or adjusted under 35 U.S.C. 154(b) by 179 days.

(21) Appl. No.: 16/463,026

(22) PCT Filed: Nov. 17, 2017

(86) PCT No.: PCT/JP2017/041415
§ 371 (c)(1),
(2) Date: May 22, 2019

(87) PCT Pub. No.: WO2018/101074
PCT Pub. Date: Jun. 7, 2018

(65) Prior Publication Data

US 2021/0118296 A1 Apr. 22, 2021

(30) Foreign Application Priority Data

Nov. 30, 2016 (JP) ..... JP2016-232881

(51) Int. Cl.
*G08G 1/13* (2006.01)
*G08G 1/01* (2006.01)

(52) U.S. Cl.
CPC ..... *G08G 1/13* (2013.01); *G08G 1/01* (2013.01)

(58) Field of Classification Search
CPC .. G08G 1/0116; G08G 1/0133; G08G 1/0145; G08G 1/065; G08G 1/0104; G08G 1/096844; G08G 1/08
See application file for complete search history.

(56) References Cited

U.S. PATENT DOCUMENTS

2008/0294331 A1* 11/2008 Fushiki ..... G08G 1/096827 701/119
2009/0138188 A1* 5/2009 Kores ..... G01C 21/32 701/117

(Continued)

FOREIGN PATENT DOCUMENTS

JP 2008-293064 A 12/2008
JP 2009-503638 A 1/2009

(Continued)

OTHER PUBLICATIONS

International Search Report for PCT Application No. PCT/JP2017/041415, dated Feb. 20, 2018.

(Continued)

*Primary Examiner* — Mirza F Alam
(74) *Attorney, Agent, or Firm* — Sughrue Mion, PLLC

(57) ABSTRACT

Provided are a traffic status estimation device and the like with which it is possible to estimate the traffic status with high precision even in a situation in which there are few sections with sensors installed therein and the vehicle travel history is inadequate. This traffic status estimation device includes: a traffic status estimation unit that estimates the traffic status in sections in which sensors are not installed on the basis of the similarity of the traffic status among sets comprising a plurality of time bands and a plurality of sections that include sections in which sensors are installed and sections in which sensors are not installed, and on the basis of the traffic status in the sections in which sensors are installed; and an output unit that outputs the traffic status estimated by the traffic status estimation unit.

10 Claims, 19 Drawing Sheets

(56) References Cited

U.S. PATENT DOCUMENTS

| | | | | |
|---|---|---|---|---|
| 2010/0286899 | A1* | 11/2010 | Jain | G08G 1/127<br>701/119 |
| 2012/0059574 | A1* | 3/2012 | Hada | G08G 1/0133<br>701/119 |
| 2017/0309171 | A1* | 10/2017 | Zhao | G08G 1/0112 |

FOREIGN PATENT DOCUMENTS

| | | | |
|---|---|---|---|
| JP | 2010-191614 | A | 9/2010 |
| WO | 2015/045695 | A1 | 4/2015 |

OTHER PUBLICATIONS

English translation of Written opinion for PCT Application No. PCT/JP2017/041415.

* cited by examiner

Fig. 6

| | $T_0A$ | $T_0B$ | $T_0C$ | $T_0D$ | $T_1A$ | $T_1B$ | $T_1C$ | $T_1D$ | $T_2A$ | $T_2B$ | $T_2C$ | ··· |
|---|---|---|---|---|---|---|---|---|---|---|---|---|
| $T_0A$ | 0 | 0 | 0 | 0 | 0 | 1 | 1 | 0 | 0 | 0 | 0 | ··· |
| $T_0B$ | 0 | 0 | 0 | 0 | 0 | 0 | 1 | 1 | 0 | 0 | 0 | ··· |
| $T_0C$ | 0 | 0 | 0 | 0 | 0 | 0 | 0 | 1 | 0 | 0 | 0 | ··· |
| $T_0D$ | 0 | 0 | 0 | 0 | 0 | 0 | 0 | 0 | 0 | 0 | 0 | ··· |
| $T_1A$ | 0 | 0 | 0 | 0 | 0 | 0 | 0 | 0 | 0 | 1 | 1 | ··· |
| $T_1B$ | 0 | 0 | 0 | 0 | 0 | 0 | 0 | 0 | 0 | 0 | 1 | ··· |
| $T_1C$ | 0 | 0 | 0 | 0 | 0 | 0 | 0 | 0 | 0 | 0 | 0 | ··· |
| $T_1D$ | 0 | 0 | 0 | 0 | 0 | 0 | 0 | 0 | 0 | 0 | 0 | ··· |
| $T_2A$ | 0 | 0 | 0 | 0 | 0 | 0 | 0 | 0 | 0 | 0 | 0 | ··· |
| $T_2B$ | 0 | 0 | 0 | 0 | 0 | 0 | 0 | 0 | 0 | 0 | 0 | ··· |
| $T_2C$ | 0 | 0 | 0 | 0 | 0 | 0 | 0 | 0 | 0 | 0 | 0 | ··· |
| ⋮ | ⋮ | ⋮ | ⋮ | ⋮ | ⋮ | ⋮ | ⋮ | ⋮ | ⋮ | ⋮ | ⋮ | ⋱ |

Fig. 7

| | $T_0A$ | $T_0B$ | $T_0C$ | $T_0D$ | $T_1A$ | $T_1B$ | $T_1C$ | $T_1D$ | $T_2A$ | $T_2B$ | $T_2C$ | ··· |
|---|---|---|---|---|---|---|---|---|---|---|---|---|
| $T_0A$ | 2 | 0 | 0 | 0 | 0 | 0 | 0 | 0 | 0 | 0 | 0 | ··· |
| $T_0B$ | 0 | 2 | 0 | 0 | 0 | 0 | 0 | 0 | 0 | 0 | 0 | ··· |
| $T_0C$ | 0 | 0 | 1 | 0 | 0 | 0 | 0 | 0 | 0 | 0 | 0 | ··· |
| $T_0D$ | 0 | 0 | 0 | 0 | 0 | 0 | 0 | 0 | 0 | 0 | 0 | ··· |
| $T_1A$ | 0 | 0 | 0 | 0 | 2 | 0 | 0 | 0 | 0 | 0 | 0 | ··· |
| $T_1B$ | 0 | 0 | 0 | 0 | 0 | 2 | 0 | 0 | 0 | 0 | 0 | ··· |
| $T_1C$ | 0 | 0 | 0 | 0 | 0 | 0 | 1 | 0 | 0 | 0 | 0 | ··· |
| $T_1D$ | 0 | 0 | 0 | 0 | 0 | 0 | 0 | 0 | 0 | 0 | 0 | ··· |
| $T_2A$ | 0 | 0 | 0 | 0 | 0 | 0 | 0 | 0 | 2 | 0 | 0 | ··· |
| $T_2B$ | 0 | 0 | 0 | 0 | 0 | 0 | 0 | 0 | 0 | 2 | 0 | ··· |
| $T_2C$ | 0 | 0 | 0 | 0 | 0 | 0 | 0 | 0 | 0 | 0 | 1 | ··· |
| ⋮ | ⋮ | ⋮ | ⋮ | ⋮ | ⋮ | ⋮ | ⋮ | ⋮ | ⋮ | ⋮ | ⋮ | ⋮ |

Fig. 8

| GPSID | TRAVEL TIME |
|---|---|
| $y_1$ | 3h |
| $y_2$ | 4h |
| $Y_3$ | 2.5h |
| ⋮ | ⋮ |

Fig. 9

| | ROUTE OF $y_1$ | ROUTE OF $y_2$ | ROUTE OF $y_3$ |
|---|---|---|---|
| $T_0A$ | 1 | 0 | 0 |
| $T_0B$ | 0 | 1 | 0 |
| $T_0C$ | 0 | 0 | 1 |
| $T_0D$ | 0 | 0 | 0 |
| $T_1A$ | 0 | 0 | 0 |
| $T_1B$ | 1 | 0 | 0 |
| $T_1C$ | 0 | 1 | 0 |
| $T_1D$ | 0 | 0 | 1 |
| $T_2A$ | 0 | 0 | 0 |
| $T_2B$ | 0 | 0 | 0 |
| ⋮ | ⋮ | ⋮ | ⋮ |

Fig. 10

| TIME ZONE/SECTION | REQUIRED TIME |
|---|---|
| $T_0A$ | 0.5h |
| $T_0B$ | 0.7h |
| $T_0C$ | 1h |
| ⋮ | ⋮ |

Fig. 14

| | $T_0A$ | $T_0B$ | $T_0C$ | $T_0D$ | $T_1A$ | $T_1B$ | $T_1C$ | $T_1D$ | $T_2A$ | $T_2B$ | $T_2C$ | ··· |
|---|---|---|---|---|---|---|---|---|---|---|---|---|
| $T_0A$ | 0 | 0 | 0 | 0 | 0 | 1 | 1 | 0 | 0 | 0 | 0 | ··· |
| $T_0B$ | 0 | 0 | 0 | 0 | 0 | 0 | 0 | 1 | 0 | 0 | 1 | ··· |
| $T_0C$ | 0 | 0 | 0 | 0 | 0 | 0 | 0 | 1 | 0 | 0 | 0 | ··· |
| $T_0D$ | 0 | 0 | 0 | 0 | 0 | 0 | 0 | 0 | 0 | 0 | 0 | ··· |
| $T_1A$ | 0 | 0 | 0 | 0 | 0 | 0 | 0 | 0 | 0 | 1 | 1 | ··· |
| $T_1B$ | 0 | 0 | 0 | 0 | 0 | 0 | 0 | 0 | 0 | 0 | 1 | ··· |
| $T_1C$ | 0 | 0 | 0 | 0 | 0 | 0 | 0 | 0 | 0 | 0 | 0 | ··· |
| $T_1D$ | 0 | 0 | 0 | 0 | 0 | 0 | 0 | 0 | 0 | 0 | 0 | ··· |
| $T_2A$ | 0 | 0 | 0 | 0 | 0 | 0 | 0 | 0 | 0 | 0 | 0 | ··· |
| $T_2B$ | 0 | 0 | 0 | 0 | 0 | 0 | 0 | 0 | 0 | 0 | 0 | ··· |
| $T_2C$ | 0 | 0 | 0 | 0 | 0 | 0 | 0 | 0 | 0 | 0 | 0 | ··· |
| ⋮ | ⋮ | ⋮ | ⋮ | ⋮ | ⋮ | ⋮ | ⋮ | ⋮ | ⋮ | ⋮ | ⋮ | ⋮ |

Fig. 15A

| TIME ZONE/SECTION | TRAFFIC FLOW (OBSERVED VALUE) |
|---|---|
| $T_0B$ | $X_{\Omega 1}$ |
| $T_0D$ | $X_{\Omega 2}$ |
| ... | ... |

Fig. 15B

| TIME ZONE/SECTION | TRAFFIC FLOW (ESTIMATED VALUE) |
|---|---|
| $T_0B$ | $W_{\Omega 1}$ |
| $T_0D$ | $W_{\Omega 2}$ |
| ⋮ | ⋮ |

Fig. 15C

| TIME ZONE/SECTION | TRAFFIC FLOW (ESTIMATED VALUE) |
|---|---|
| $T_0A$ | $W_1$ |
| $T_0B$ | $W_2$ |
| $T_0C$ | $W_3$ |
| ⋮ | ⋮ |

TIME ZONE $T_0$

TIME ZONE $T_1$

TIME ZONE $T_0$

TIME ZONE $T_1$

TRAFFIC STATUS ESTIMATION DEVICE, TRAFFIC STATUS ESTIMATION METHOD, AND PROGRAM RECORDING MEDIUM

TECHNICAL FIELD

The present disclosure relates to a traffic status estimation device, a traffic status estimation method, a program recording medium, and an output device.

BACKGROUND ART

It is important for a road administrator to measure and monitor a traffic status at each point on a road in order to manage safety and maintain road quality. Accordingly, a traffic control system in which various measurement instruments are installed on a road and pieces of information indicated by the measurement instruments are collected and utilized is constructed. As the measurement instruments, a vehicle detector using a loop coil and a vehicle detector that performs image processing on a video image captured by a closed-circuit television (CCTV) camera and recognizes each vehicle body are used. As the measurement instruments, an instrument using ultrasonic waves, an optical vehicle detector, may also be used.

Monitoring a traffic status by using such measurement instruments (sensors) requires not only installation of the sensors themselves, but also installation of a processing device for processing information acquired from the sensors, a communication line between the processing device and the traffic control system, which leads to an increase in cost. Therefore, it is difficult to arrange sensors (installation type sensors) in all road sections, and thus sensors are often arranged only in important road sections, such as a road section in which a traffic jam is likely to occur. On the other hand, in terms of safety management, it is also necessary to recognize a status even of a road section that is not recognized to be important by the road administrator, for example, when an accident or an unsteady traffic jam occurs. However, it is difficult to monitor the status of the road section because of the cost problem as described above.

In addition, traffic status observation in which an onboard Global Positioning System (GPS) device, which has recently become popular, is used and a sensor or the like is not installed has been considered. The traffic status observation using a GPS has advantages that, for example, the road administrator's expense is low and the traffic status can be observed at a point where an installation type sensor is not arranged.

On the other hand, in the traffic status observation using a GPS, the traffic status cannot be observed unless a vehicle having an onboard GPS device mounted thereon travels, and therefore, a large deviation occurs at observation points depending on a time and a region. In addition, the traffic status observation using a GPS is affected by an observation error of the GPS. Accordingly, an observation error is likely to increase, especially, at a center of a town where a satellite position cannot be easily recognized. Even when a travel speed and a travel time of a GPS-mounted vehicle can be observed, it is difficult to acquire information about the entire road section, for example, information such as an average travel speed, the number of passed vehicles, and a vehicle density.

In order to deal with such a problem, a technique for increasing the number of points where the traffic status can be observed and improving observation accuracy by combining the traffic status observation using the above-described installation type sensor with the traffic status observation using a GPS has been considered.

PTL 1 discloses a traffic amount measurement device that achieves improvement in accuracy of measuring the number of vehicles remaining in an inflow link, while suppressing an increase in cost for construction of a system, operation, maintenance management.

In the traffic amount measurement device in PTL 1, for example, between two intersections where a sensor is installed, the number of vehicles present in an unobserved road section is estimated by using a difference between the number of passed vehicles at the inflow-side intersection and the number of passed vehicles at the outflow-side intersection, and a correction factor indicating a ratio of an outflow to an unknown branch road to an inflow from a branch road.

In addition, PTL 2 discloses a method of estimating a traffic status at an unobserved point by combining information observed by an installation type sensor with information observed by a GPS. In PTL 2, a regression analysis is conducted by recognizing an observed velocity acquired by a GPS as teaching data and by using a velocity observed by the installation type sensor as an explanatory variable and a velocity observed by the GPS as an objective variable, thereby estimating speed information with high accuracy at any time, based on information from the installation type sensor.

CITATION LIST

Patent Literature

[PTL 1] International Patent Publication No. WO 2015/045695

[PTL 2] Specification of U.S. Patent Application Publication No. 2010/0286899

SUMMARY OF INVENTION

Technical Problem

By the technique disclosed in PTL 1 as described above, a ratio of remaining vehicles in an unobserved section can be estimated in consideration of a road movement time observed by a GPS. However, in the method of PTL 1, an unobserved section that is present between adjacent intersections is taken as an object, and the number of vehicles in the unobserved section is estimated based on information about the traffic amounts at the two adjacent points. Accordingly, when the unobserved section includes a plurality of branch roads, the number of vehicles in the unobserved section varies depending on a combination of flow dividing ratios at branch roads. Therefore, it is difficult to estimate the number of vehicles in the unobserved section, based only on the traffic amounts at the observed insertions that are boundaries with the unobserved section.

For this reason, there is a problem that it is difficult to estimate a traffic amount.

In the technique of PTL 2, a regression model for performing an estimation at an unobserved point is constructed in such a way as to comply with observation using a GPS. However, since this model construction uses GPS information as teaching data, the number of points at which estimation cannot be performed increases when sufficient GPS information is not acquired.

The present invention has been made in view of the above-described problems, and a principal object of the present invention is to provide a traffic status estimation device capable of estimating a traffic status with high accuracy even in a status where the number of sections in which a sensor is installed is small and a vehicle travel history is not sufficient.

Solution to Problem

In one aspect of the present invention, a traffic status estimation device includes:

traffic status estimation means for estimating a traffic status in a section in which a sensor is not installed, based on a traffic status in a section in which a sensor is installed and a similarity in a traffic status between pairs of each of a plurality of time zones and each of a plurality of sections including a section in which the sensor is installed and a section in which the sensor is not installed; and output means for outputting the traffic status estimated by the traffic status estimation means.

In one aspect of the present invention, a traffic status estimation method includes:

estimating a traffic status in a section in which a sensor is not installed, based on a traffic status in a section in which a sensor is installed and a similarity in a traffic status between pairs of each of a plurality of time zones and each of a plurality of sections including a section in which the sensor is installed and a section in which the sensor is not installed; and outputting the traffic status estimated.

In one aspect of the present invention, a program recording medium stores a program which causes a computer to execute processing of:

estimating a traffic status in a section in which a sensor is not installed, based on a traffic status in a section in which a sensor is installed and a similarity in a traffic status between pairs of each of a plurality of time zones and each of a plurality of sections including a section in which the sensor is installed and a section in which the sensor is not installed; and outputting the traffic status estimated.

In one aspect of the present invention, an output device includes:

output means for outputting a traffic status in a section in which a sensor is not installed, estimated based on a traffic status in a section in which a sensor is installed and a similarity in a traffic status between pairs of each of a plurality of time zones and each of a plurality of sections including a section in which the sensor is installed and a section in which the sensor is not installed.

Advantageous Effects of Invention

According to the present invention, it is possible to obtain an advantageous effect that a traffic status can be estimated with high accuracy even in a status where the number of sections in which a sensor is installed is small and a vehicle travel history is not sufficient.

BRIEF DESCRIPTION OF DRAWINGS

FIG. 6 is a diagram illustrating an example of adjacency matrices based on a connection relationship;

FIG. 7 is a diagram illustrating an example of degree matrices based on a connection relationship;

FIG. 8 is a diagram illustrating an example of a total travel time;

FIG. 9 is a diagram illustrating an example of matrices each indicating a travel route of a GPS-mounted vehicle;

FIG. 10 is a diagram illustrating an example of an estimated required time;

FIG. 14 is a diagram illustrating adjacency matrices updated based on the updated time-space topology;

FIG. 15A is a diagram illustrating an example of a traffic flow (an observed value) in a road section in which a sensor is installed;

FIG. 15B is a diagram illustrating an example of a traffic flow (an estimate value) in a road section in which a sensor is installed;

FIG. 15C is a diagram illustrating an example of a traffic flow (an estimate value) in a road section in which a sensor is installed;

EXAMPLE EMBODIMENT

Example embodiments of the present invention will be described in detail below with reference to the drawings.

First Example Embodiment

Figure 1:
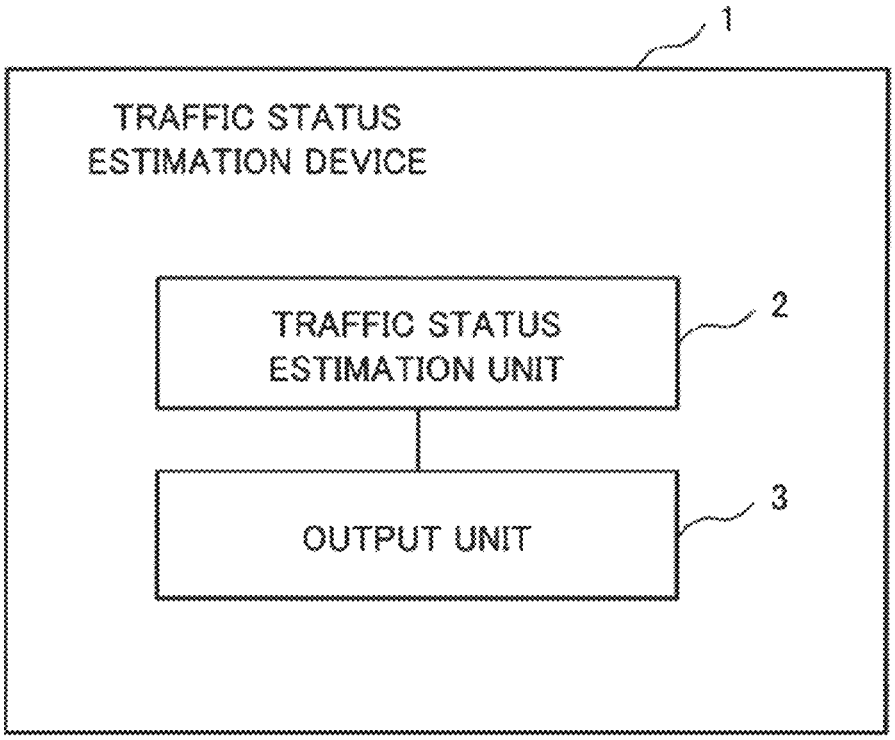
FIG. 1 is a diagram illustrating a configuration of a traffic status estimation device according to a first example embodiment of the present invention.

FIG. 1 is a diagram illustrating a configuration of a traffic status estimation device 1 according to a first example embodiment of the present invention. The traffic status estimation device 1 according to the first example embodiment includes a traffic status estimation unit 2 and an output unit 3.

The traffic status estimation unit 2 estimates a traffic status in a section in which a sensor is not installed, based on a traffic status in a section in which a sensor is installed and a similarity in a traffic status between pairs of each of a plurality of time zones and each of a plurality of sections including a section in which the sensor is installed and the section in which the sensor is not installed.

The output unit 3 outputs the traffic status estimated by the traffic status estimation unit 2.

By employing the configuration described above, according to the first example embodiment, the traffic status in the section in which the sensor is not installed can be estimated. Accordingly, an advantageous effect that the traffic status can be estimated with high accuracy can be acquired even in a status where the number of sections in which a sensor is installed is small and a vehicle travel history is not sufficient.

The traffic status estimation unit 2 and the output unit 3 can be implemented by, for example, a sensor information management unit 150 and an output device 170, respectively, which are described below. Further, the output device 170 is included in an output device.

Second Example Embodiment

Figure 2:
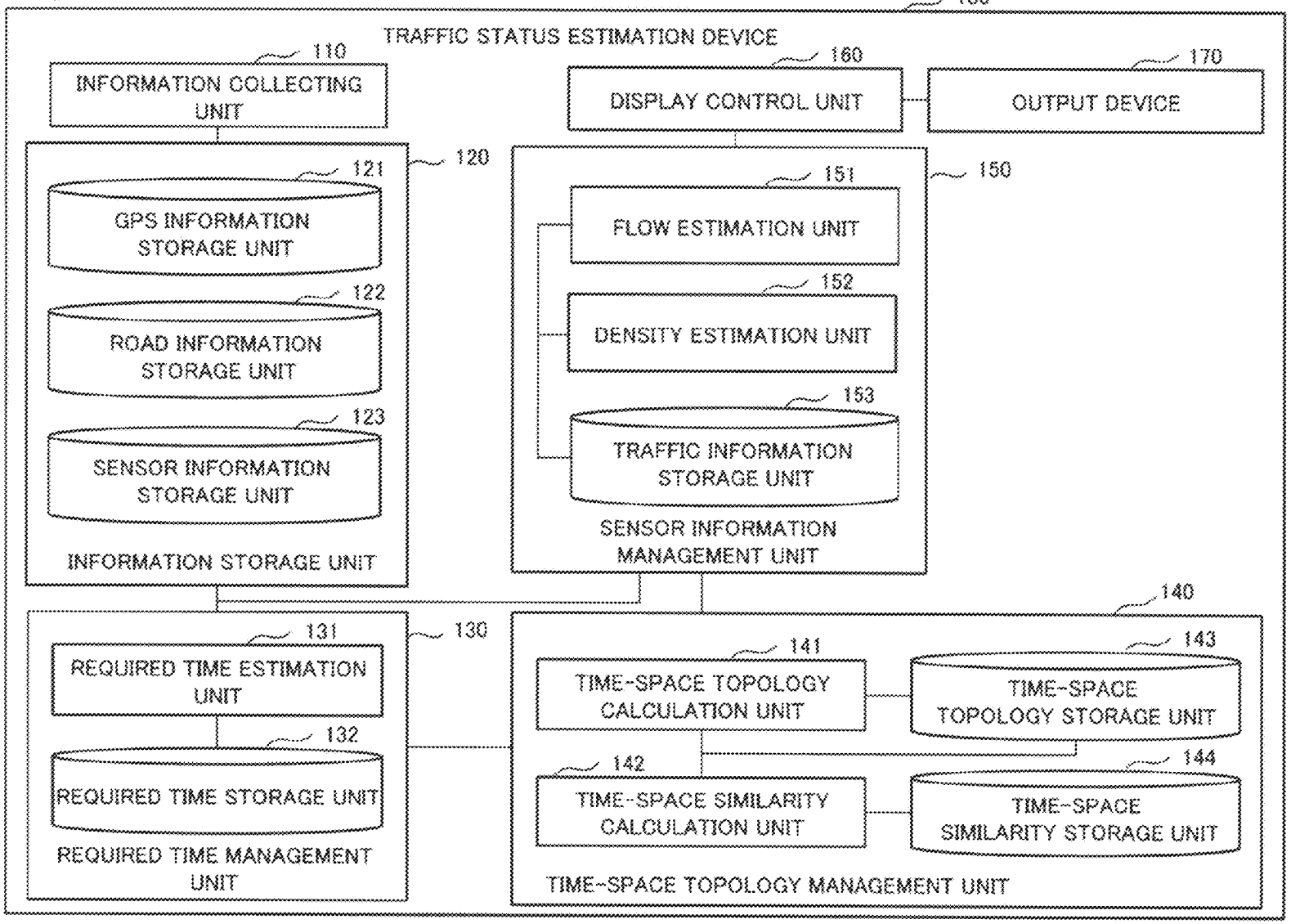
FIG. 2 is a diagram illustrating a configuration of a traffic status estimation device according to a second example embodiment of the present invention.

FIG. 2 is a diagram illustrating a configuration of a traffic status estimation device 100 according to a second example embodiment of the present invention. The traffic status estimation device 100 according to the second example embodiment includes an information collecting unit 110, an information storage unit 120, a required time management unit 130, a time-space topology management unit 140, a sensor information management unit 150, a display control unit 160, and an output device 170.

The information storage unit 120 includes a GPS information storage unit 121, a road information storage unit 122, and a sensor information storage unit 123.

The required time management unit 130 includes a required time estimation unit 131 and a required time storage unit 132.

The time-space topology management unit 140 includes a time-space topology calculation unit 141, a time-space similarity calculation unit 142, a time-space topology storage unit 143, and a time-space similarity storage unit 144.

A time estimation means and a similarity update means can be implemented by, for example, the required time estimation unit 131 and the time-space similarity calculation unit 142, respectively.

An outline of each component will be described.

The information collecting unit 110 receives traffic information (hereinafter, also referred to as "GPS information") observed by a GPS from a GPS-on-vehicle device, a mobile telephone terminal, or the like, which is mounted on a vehicle, and stores the traffic information in the GPS information storage unit 121. The information collecting unit 110 also receives traffic information (hereinafter, also referred to as "sensor information") measured by a sensor installed in a road, and stores the traffic information in the sensor information storage unit 123.

The GPS information storage unit 121 of the information storage unit 120 stores the GPS information received by the information collecting unit 110. The road information storage unit 122 stores information about a road structure, such as the number of lanes in each road section, a distance of each section, and a connection relationship with another road.

The sensor information storage unit 123 stores the sensor information received by the information collecting unit 110.

The required time management unit 130 estimates, for each time zone, a time required for a vehicle to move each road section, based on the traffic information observed by the GPS. Specifically, the required time estimation unit 131 of the required time management unit 130 estimates a required time in a road section in which a vehicle having a GPS-on-vehicle device mounted thereon (hereinafter, also referred to as "GPS-mounted vehicle") has not traveled, based on the traffic information observed by the GPS, thereby acquiring, for each time zone, each time required for movement of the vehicle in each road section. Note that the traffic information observed by the GPS is a vehicle travel history and includes a section and a time zone in which the vehicle travels.

The time zone described herein refers to a time width acquired by, for example, dividing 24 hours into a predetermined time. Note that not only 24 hours, but also a predetermined time may be addressed.

The required time storage unit 132 stores a time required for movement of each road section in each time zone, including information estimated by the required time estimation unit 131.

The time-space topology management unit 140 calculates a time-space topology and a time-space similarity. Specifically, the time-space topology calculation unit 141 of the time-space topology management unit 140 calculates and updates the time-space topology, based on the road connection relationship stored in the road information storage unit 122 and each time required for movement of each road section in each time zone, which is calculated by the required time management unit 130. The time-space topology indicates the connection relationship between a time zone and a road section (to be described in detail below). Note that in the following description, the "time required for movement of a road section" is also referred to as a "time required for a road section".

The time-space topology storage unit 143 stores the time-space topology calculated by the time-space topology calculation unit 141.

The time-space similarity calculation unit 142 calculates a time-space similarity indicating a similarity in a traffic status between road sections in each time zone, based on the time-space topology stored in the time-space topology storage unit 143. The time-space similarity indicates an effect of the traffic amount existing in each road section in each time zone on another road section in another time zone. The time-space similarity storage unit 144 stores the time-space similarity calculated by the time-space similarity calculation unit 142.

The sensor information management unit 150 estimates sensor information, based on the time-space similarity calculated by the time-space topology management unit 140. Specifically, a flow estimation unit 151 of the sensor information management unit 150 estimates a traffic flow (hereinafter, also referred to as "flow") in a road section in which a sensor is not installed, based on the time-space similarity calculated by the time-space topology management unit 140 and the sensor information stored in the sensor information storage unit 123. The traffic flow indicates the number of vehicles passing a point per unit time (the number of passed vehicles).

A density estimation unit 152 estimates a vehicle density (hereinafter, also referred to as "density") in a road section in which a sensor is not installed, based on the time-space similarity calculated by the time-space topology management unit 140 and the sensor information stored in the sensor information storage unit 123. The vehicle density indicates the number of vehicles per unit length, e.g., per kilometer.

A traffic information storage unit 153 stores traffic information such as the flow and density estimated by the flow estimation unit 151 and the density estimation unit 152.

The display control unit 160 displays, on the output device 170 (display device), the flow, density, required time, a vehicle speed, for each road section, based on the traffic information stored in the traffic information storage unit 153. The output device 170 displays the information as described above, based on the control by the display control unit 160.

Next, an operation according to the example embodiment of the present invention will be described.

Figure 3:
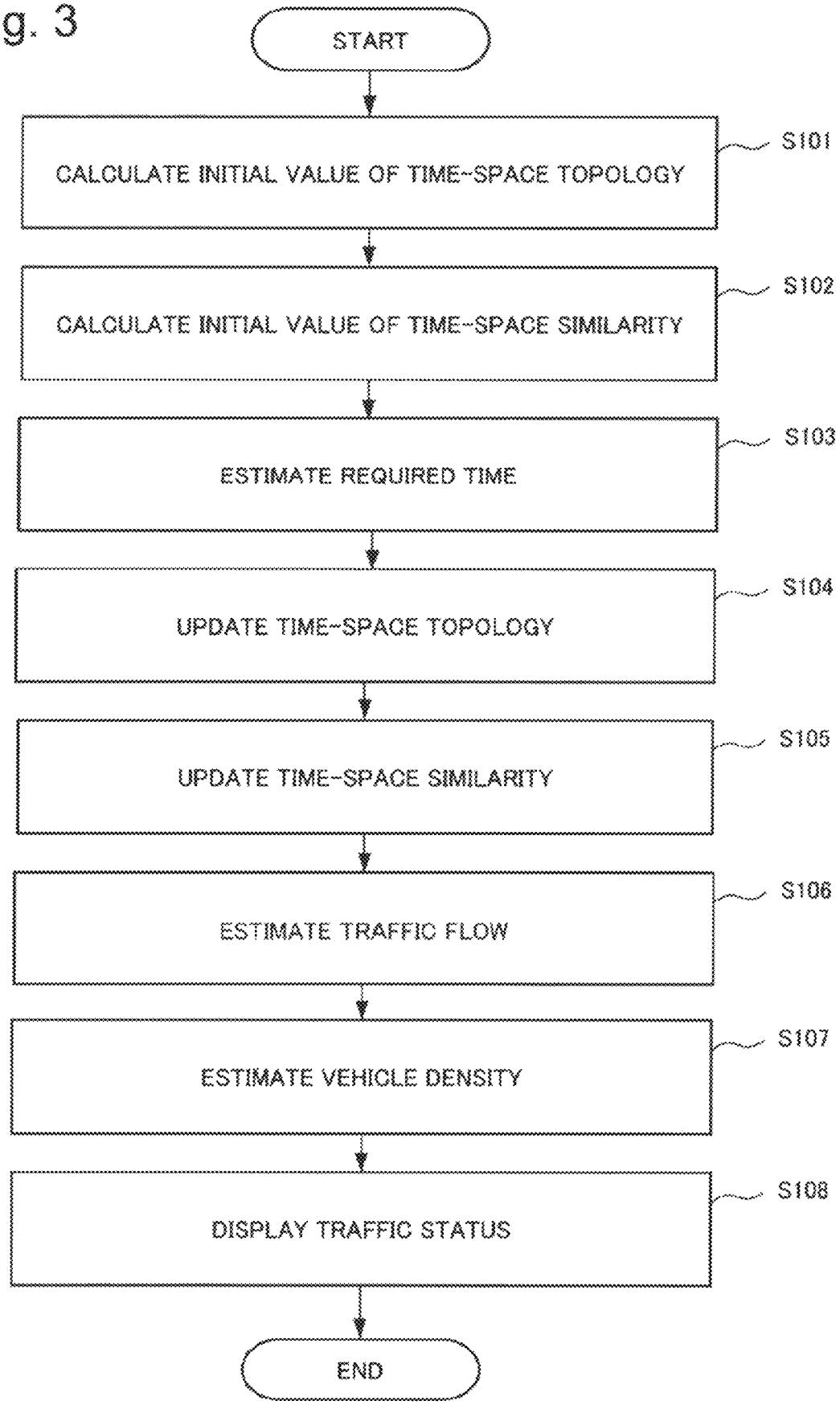
FIG. 3 is a flowchart illustrating traffic status estimation processing to be performed by the traffic status estimation device according to the second example embodiment of the present invention.

FIG. 3 is a flowchart illustrating traffic status estimation processing to be performed by the traffic status estimation device 100. An operation of the traffic status estimation device 100 will be described with reference to FIG. 3.

An outline of the operation of the traffic status estimation device 100 will be described below. Specifically, the time-space topology management unit 140 of the traffic status estimation device 100 calculates an initial value of the time-space topology (step S101), and calculates an initial value of the time-space similarity, based on the initial value (step S102).

Based on the initial value of the time-space similarity, the required time management unit 130 estimates GPS information in a road section in which GPS information is not acquired, especially, estimates a required time in the road section (step S103). Subsequently, the time-space topology management unit 140 updates the time-space topology calculated as described above, based on the estimated required time (step S104), and updates the time-space similarity, based on the updated time-space topology (step S105).

Further, the sensor information management unit 150 estimates the flow and density in a road section in which sensor information is not acquired, based on the updated time-space similarity and the acquired sensor information (steps S106 and S107). Note that the estimation of the traffic status in a road section in which observation is not made by a GPS or a fixed sensor (hereinafter, also referred to as a "unobserved section") based on the traffic status in a road section in which observation is made by a GPS or a fixed sensor (hereinafter, also referred to as an "observed section") may be referred to as "complementation".

When the estimation is completed, the display control unit 160 displays, on the output device 170, the traffic status in all road sections, including the estimated flow and density (step S108).

The operation of the traffic status estimation device 100 described above will be described in detail below.

First, collection of information for the above-described operation will be described.

The information collecting unit 110 converts positional information with a time stamp, which is collected from an on-vehicle terminal, a mobile phone terminal, or the like on which a GPS receiver is mounted, into a required time and a travel speed (hereinafter, referred to as a "speed") in a road section at a time when a vehicle having a GPS receiver travels, and stores the converted information in the GPS information storage unit 121. The information collecting unit 110 may perform the above-described conversion by itself, or may receive information collected and converted by another device and store the information in the GPS information storage unit 121. Note that the speed indicates an average speed of a plurality of vehicles in a road section.

The information collecting unit 110 also collects sensor information observed by each fixed sensor installed on a freeway, an intersection, an important road section, or the like, and stores the information in the sensor information storage unit 123. The sensor information includes the speed, flow, and density of the vehicle in a road section in which the sensor is installed. The sensor information may be received from a sensor, a processing device connected to the sensor, or the like, or information collected by another device, such as a traffic control device, may be received and stored.

As for the GPS information, the required time and the vehicle speed only in the road section in the time zone in which the vehicle having a GPS receiver mounted thereon has traveled are stored. As for the sensor information, the vehicle speed, traffic flow, vehicle density, and required time in all time zones only in the road section in which a fixed sensor is installed are stored. The traffic status estimation device 100 has a function for estimating the traffic status in such a manner that the traffic status in a road section in a time zone with no information is complemented by using these pieces of stored information, and providing a user with the traffic status.

Note that it is assumed that the road information storage unit 122 preliminarily stores information about a road structure, such as the number of lanes in each road section, the distance of each section, and a connection relationship with another road.

Next, the calculation of the time-space similarity in the time-space topology management unit 140 illustrated in the step S101 of FIG. 3 will be described. The time-space topology management unit 140 may perform the following calculation at any timing when GPS information and sensor information are accumulated in the GPS information storage unit 121 and the sensor information storage unit 123, respectively, or at a predetermined timing.

The time-space topology management unit 140 calculates the time-space similarity required for estimation of the GPS information and estimation of the sensor information. The time-space similarity is a value representing a degree of influence of the traffic status in a certain road section in a certain time zone (time) on the traffic status in another road section in another time zone. Specifically, the time-space similarity is the following value.

A traffic flow started from a certain road section arrives at another road section with a lapse of time, and further passes through the road section. In this case, the traffic flow started in the past has an influence on the traffic status in the road section at which the traffic flow arrives. The time-space similarity is a value acquired by representing the degree of influence for each time zone. The use of the time-space similarity makes it possible to estimate a variation in the traffic status in the unobserved section, based on the traffic status in the section in which observation is made by a GPS or a fixed sensor.

The time-space topology management unit 140 first calculates an initial value of the time-space topology before estimating the GPS information and estimating the sensor information.

Figure 4:
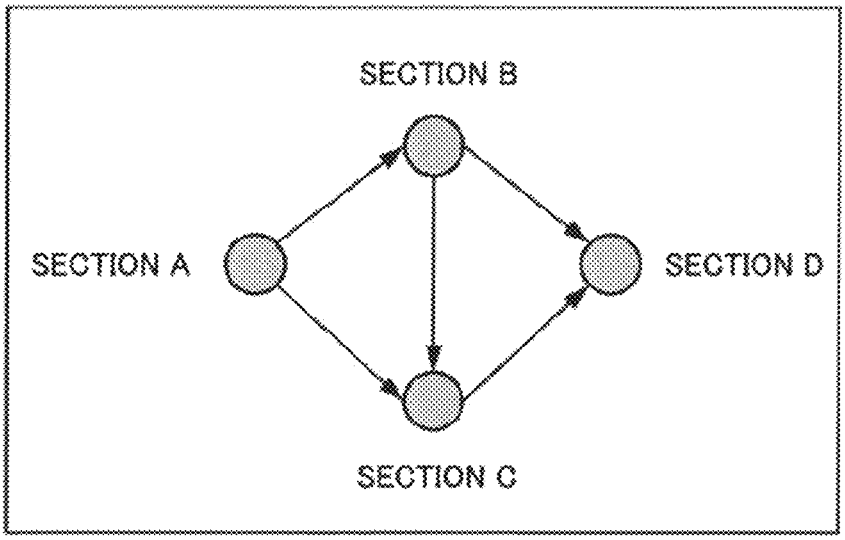
FIG. 4 is a diagram illustrating an example of a connection relationship between road sections.

FIG. 4 is a diagram illustrating an example of a connection relationship (an adjacency relationship) in a road section. FIG. 4 illustrates that it is possible to move from a road section (hereinafter, also referred to simply as a "section") A to sections B and C, from the section B to sections C and D, and from the section C to the section D. In FIG. 4, the movement from a section to another section is indicated by a one-way link, but may be indicated by a bidirectional link. Only the one-way link will be described below for convenience of explanation. The connection relationship between road sections as illustrated in FIG. 4 is also referred to as a "road topology".

The time-space topology calculation unit 141 generates a time-space topology in order to represent that a certain road section in a certain time zone is related to which road section in which time zone.

Figure 5A:
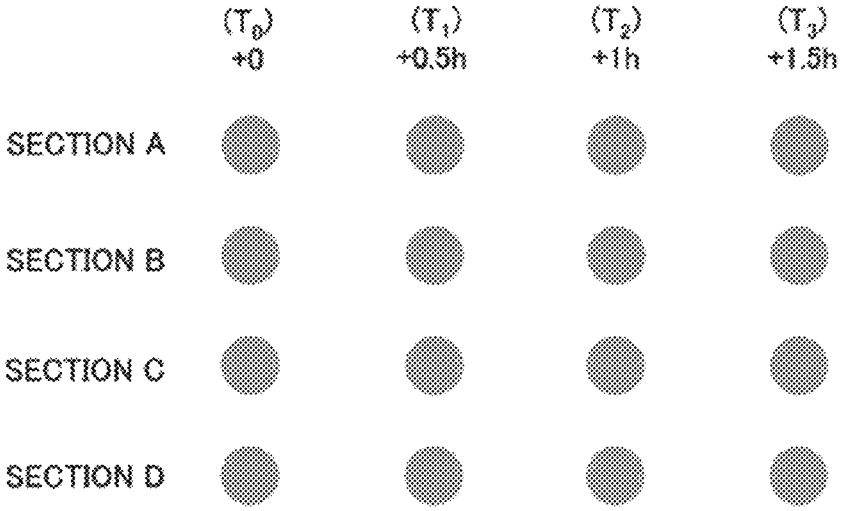
FIG. 5A is a diagram illustrating generation of a time-space topology based on a road topology.
Figure 5B:
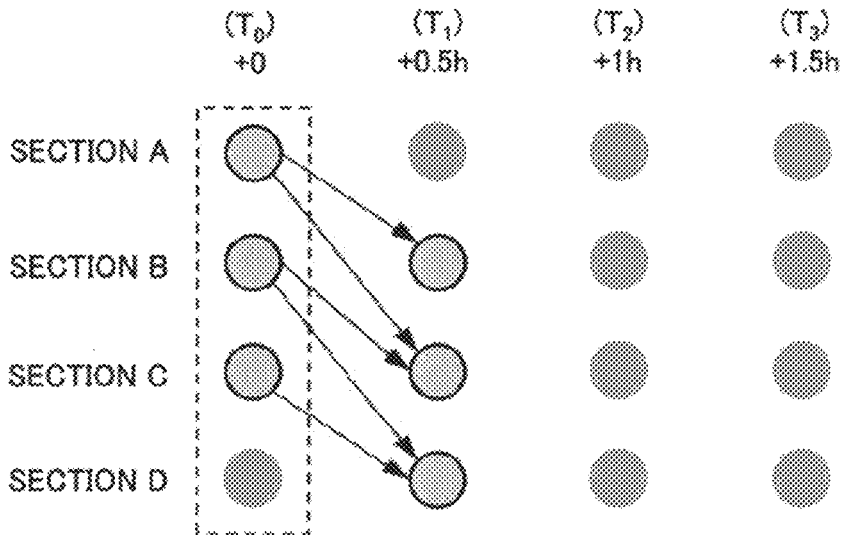
FIG. 5B is a diagram illustrating the generation of the time-space topology based on the road topology.
Figure 5C:
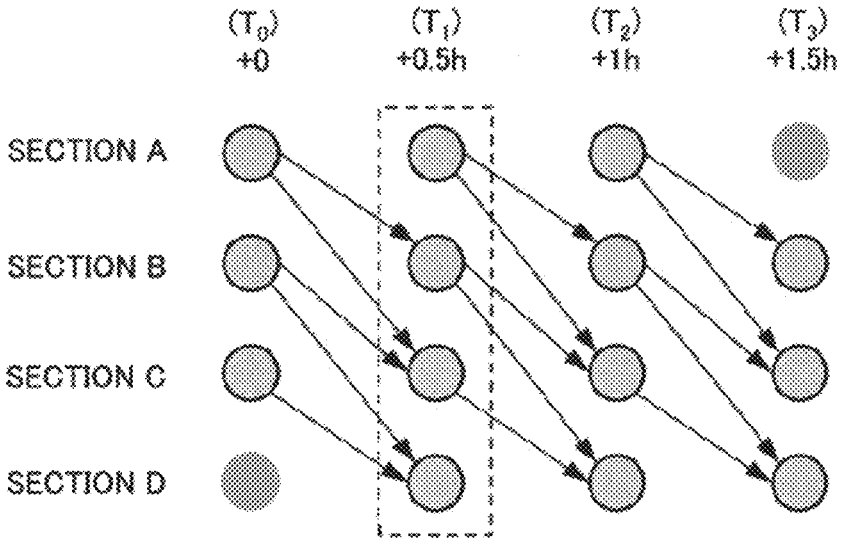
FIG. 5C is a diagram illustrating the generation of the time-space topology based on the road topology.

FIGS. 5A to 5C are diagrams each illustrating generation of a time-space topology based on the road topology illustrated in FIG. 4. In FIGS. 5A to 5C, each state of sections A to D in time zones $T_0$ to $T_3$ is represented by a node. The time zones $T_1$, $T_2$, and $T_3$ indicate a time zone after 30 minutes from the time zone $T_0$, a time zone after one hour from the time zone $T_0$, and a time zone after one and a half hour from the time zone $T_0$, respectively. The generation of the time-space topology will be described with reference to FIGS. 5A to 5C.

The time-space topology calculation unit 141 generates a link from the state illustrated in FIG. 5A to each node, i.e., from a node in a certain road section in a certain time zone to another node on which the node can have an influence. As illustrated in FIG. 5B, the time-space topology calculation unit 141 first focuses on the sections A to D in the time zone $T_0$, and connects links to a node in a road section directly connected to each section. Note that it is assumed that there is no link to a node after 30 minutes in the same section.

In this example embodiment, the connection relationship is based on an idea that there is a possibility that the traffic status in a section may have an influence only on adjacent road sections after a lapse of a short period of time, but does not directly affect nodes subsequent to the adjacent nodes.

Subsequently, as illustrated in FIG. 5C, the time-space topology calculation unit 141 focuses on each section in the time zone $T_1$, and similarly connects links to a node in a section directly connected to each section. After that, the time-space topology calculation unit 141 also connects links in a similar manner. A structure as illustrated in FIG. 5C is also referred to as a graph structure.

Although a transition of the state described above is indicated every 30 minutes, the transition time is not limited to this. The transition may be indicated every 15 minutes, or based on other values.

The time-space topology calculation unit 141 stores the time-space topology calculated as described above in the time-space topology storage unit 143. As described above, the time-space topology calculation unit 141 calculates an initial value (initial state) of the time-space topology.

When the initial value is calculated, the time-space topology calculation unit 141 instructs the time-space similarity calculation unit 142 to calculate the time-space similarity. The time-space similarity calculation unit 142 calculates the initial value of the time-space similarity illustrated in the step S102 of FIG. 3 in response to the instruction described above.

The calculation of the initial value of the time-space similarity will be described below. The time-space similarity calculation unit 142 calculates the time-space similarity between road sections in each time zone, based on the time-space topology.

The initial value of the time-space topology described above indicates only the connection relationships in which all possibilities of being influenced by the traffic flow are listed. Accordingly, the time-space similarity calculation unit 142 calculates the time-space similarity indicating the degree of influence in each connection relationship. The time-space similarity (hereinafter, also referred to simply as "similarity") is calculated based on, for example, the following equation (1).

$$K(\beta, p) = \left(I + \frac{\beta}{p}H\right)^p \tag{1}$$

Here, "K" represents a similarity matrix having a similarity between nodes in the time-space topology as an element. In the similarity matrix K, the element located in an i-th row and in a j-th column (i and j are integers) indicates a similarity between a node i and a node j. Each node in the time-space topology indicates a state in a certain road section in a certain time zone. Accordingly, the similarity matrix K is a square matrix including elements corresponding to the number of rows and the number of columns (the number of time zones× the number of road sections).

Specifically, when the time zones are represented by $T_0$, $T_1$, $T_2$, $T_3$, . . . , respectively, and the sections are represented by A, B, C, D, . . . , respectively, the similarity matrix K is a square matrix including $T_0A$, $T_0B$, $T_0C$, $T_0D$, $T_1A$, $T_1B$, $T_1C$, $T_1D$, $T_2A$, . . . in rows and columns.

Each of "β" and "p" is a type of tuning parameter called a hyper parameter, which is a value that determines the degree of transmission of each value observed by a GPS or a sensor. Each of "β" and "p" may be set by the user before the time-space topology is calculated, or may be set by selecting a highly accurate value based on previous data. "p" represents a value indicating how many hops in the time-space topology are similar, and values observed only in the neighborhood are transmitted as "p" decreases. "β" represents a transmission rate, which is a value that determines at which ratio transmission is carried out up to the degree of transmission determined by p. Each of "β" and "p" may be a constant value.

"I" represents a unit matrix that has the same size as the similarity matrix K and includes diagonal components each indicating "1" and other components each indicating "0". "H" represents the graph Laplacian of the time-space topology. The graph Laplacian of the time-space topology is calculated based on the following equation (2).

$$H=D-A \tag{2}$$

Here, "D" represents a degree matrix in the time-space topology which has a degree of each node in the diagonal component. "A" represents an adjacency matrix indicating the connection relationship in the time-space topology.

FIG. 6 is a diagram illustrating an example of the adjacency matrix A based on the connection relationship illustrated in FIG. 5C. In FIG. 6, when each row is a connection source node in FIG. 5C and each column is a connection destination node in FIG. 5C, an element between the nodes i and j having a connection relationship with each other is represented by "1" and an element between the nodes i and j having no connection relationship is represented by "0". Note that since there is no link between the nodes, all diagonal components are represented by "0".

FIG. 7 is a diagram illustrating an example of the degree matrix D based on the connection relationship illustrated in FIG. 5C. As illustrated in FIG. 7, the degree matrix D is a diagonal matrix in which the degree of the node i (the number of links starting from the node i) is represented by a diagonal component.

Note that the time-space similarity is not limited to the calculations based on the above-described equations (1) and (2). For example, the similarity k (i, j) between the node i and the node j may be obtained by the following equation (3).

$$k(i,j)=\exp(d_{i,j}) \tag{3}$$

Here, $d_{i,j}$ represents a minimum hop number between the node i and the node j.

The time-space similarity calculation unit 142 stores the similarity matrix K indicating the time-space similarity calculated by using the equation (1) or (3) in the time-space similarity storage unit 144. By the above-described procedure, the time-space similarity calculation unit 142 calculates the initial value of the time-space similarity.

When the initial value is calculated, the time-space similarity calculation unit 142 instructs the required time management unit 130 to estimate the required time. The required time management unit 130 estimates the required time illustrated in the step S103 of FIG. 3 in response to the instruction described above.

The estimation of the required time will be described below. The required time management unit 130 estimates the required time in the required time estimation unit 131. As described above, the time-space similarity is a value indicating the degree of similarity of the state of a certain road section in a certain time zone to the state of another road section in another time zone. Accordingly, based on the time-space similarity calculated by the time-space topology management unit 140, the required time estimation unit 131 can estimate a required time in a road section in which GPS information is not present, i.e., in an unobserved road section, from the required time in a road section in which GPS information is present, i.e., in an observed road section.

The required time estimation unit 131 performs the above-described estimation based on the following expression (4).

$$\min_f\left(\|y-Q^Tf\|^2+\lambda f^TKf\right) \tag{4}$$

Here, "y" represents a total time of traveling of each GPS-mounted vehicle (total travel time), which is the actually observed time acquired from the observation result by the GPS. FIG. 8 is a diagram illustrating an example of the total travel time y. As illustrated in FIG. 8, "y" is a vector that includes a continuous travel time for, for example, each GPS-mounted vehicle (i.e., for each GPS) and has a length corresponding to the number of observations by the GPS. For example, "3h" in FIG. 8 is a time during which the vehicle having the GPS with GPSID (GPSIdentification)="$y_1$" mounted thereon has continuously traveled.

"Q" represents a matrix indicating a travel route for each GPS-mounted vehicle. FIG. 9 is a diagram illustrating an example of the matrix Q. As illustrated in FIG. 9, each row in the matrix Q indicates a road section (e.g., A, B, C, D, . . . ) in a time zone (e.g., $T_0$, $T_1$, $T_2$, . . . ), and each column indicates a road section (route) through which each GPS-mounted vehicle has passed. When a certain GPS-mounted vehicle travels in a road section in a time zone indicated by a row, "1" is input for the element of Q, and in the other cases, "0" is input for the element of Q.

"f" indicates a vector having a length of (the number of time zones× the number of road sections) and having a required time in each road section in each time zone as an element. The element of f is a value estimated by the required time estimation unit 131.

The required time estimation unit 131 searches for "f", which is a minimum value, in the expression (4) by using a mathematical optimization method. As the mathematical optimization method, specifically, for example, an internal point method can be used. FIG. 10 is a diagram illustrating the required time f estimated by the expression (4). As illustrated in FIG. 10, the required time f has a required time in each road section in each time zone as an element.

In this case, $Q^Tf$ represents a travel time obtained by totalizing required times in sections in which each GPS-mounted vehicle has traveled. As described above, "y" represents a total travel time of all GPS-mounted vehicles which is obtained from observation results from the GPS. Accordingly, the first term in the expression (4) indicates a difference between the total travel time of all GPS-mounted vehicles and the total required time in road sections in which each vehicle has traveled.

When the estimation of "f" is accurate, the difference between y and $Q^Tf$ becomes equal by removing an observation error caused by GPS observation. Accordingly, by minimizing this difference, the required time in each road section in each time zone can be estimated.

Further, the second term in the expression (4) indicates that the difference in the element of f between nodes having a high time-space similarity is minimized based on the similarity matrix K indicating the time-space similarity. Specifically, f is estimated in such a manner that the difference between the elements of f is minimized based on the premise that nodes having a high time-space similarity take close elements of f. According to this term, a required time in a road section in a time zone in which no GPS-mounted vehicle travels can also be estimated based on the value of the required time in the observed road section.

Note that λ represents a weight parameter between the first term and the second term, and the estimation in which more emphasis is placed on the time-space similarity as λ increases is carried out.

The required time estimation unit 131 estimates the required time in each road section in each time zone by the above-described procedure. The required time estimation unit 131 stores the estimated value in the required time storage unit 132.

In this case, the required time estimation unit 131 may calculate the vehicle speed, based on the required time estimated as described above. Specifically, the required time estimation unit 131 may calculate a speed of the vehicle that travels in each road section in each time zone (hereinafter, also referred to as "speed in each road section") based on the estimated required time. The speed in each road section can be calculated by (the length of a road section÷ the required time in the road section). The required time estimation unit 131 stores the calculated speed in the traffic information storage unit 153.

Note that when the calculated speed includes an abnormal value, the required time estimation unit 131 may correct the value. For example, the required time estimation unit 131 may regard a speed that far exceeds a legal speed as an abnormal speed and may replace the abnormal speed with the legal speed. Further, the speed calculated as described above may be used to be presented to the user as described below.

As described above, when the estimation of the required time, including the estimation of the required time in the unobserved section, is completed, the required time management unit 130 instructs the time-space topology management unit 140 to update the time-space topology and update the time-space similarity.

The time-space topology management unit 140 updates the time-space topology and updates the time-space similarity as illustrated in the steps S104 and S105 of FIG. 3 in response to the instruction described above, based on the required time estimated as described above.

Updating of the time-space topology will be described below. The time-space topology calculation unit 141 updates the time-space topology based on the required time estimated by the required time management unit 130. The time-space topology illustrated in FIG. 5C is an initial topology in which all nodes that can have an influence in a unit time duration (0.5 hours (h) in FIG. 5C) are listed and connected. The initial topology (hereinafter, also referred to as an "initial value in the topology") is calculated based on an assumption that each node is most effective on a node after 30 minutes in an adjacent road section in the road topology.

FIG. 5B illustrates an initial topology when the time zone $T_0$ is focused. First, updating of the initial topology when the time zone $T_0$ is focused will now be described.

Figure 11:
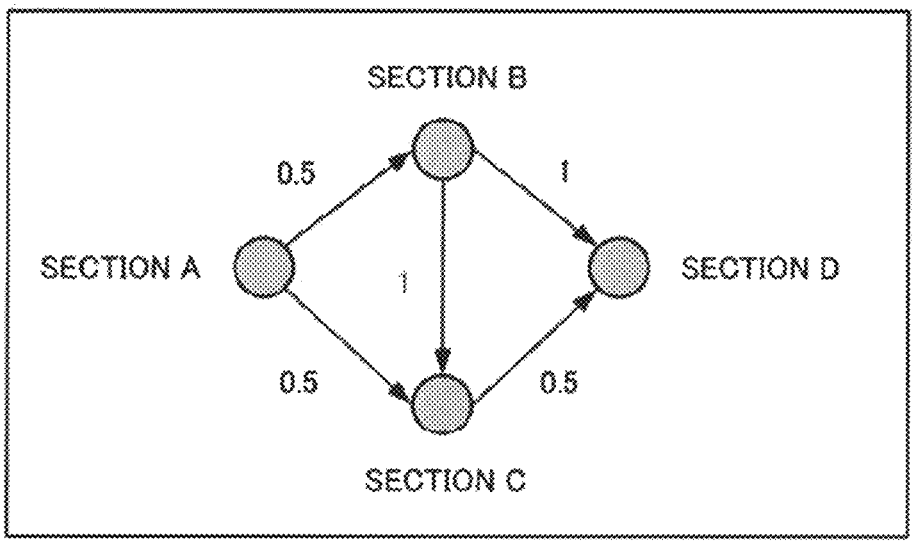
FIG. 11 is a diagram illustrating a time required for movement in a section, including a value estimated by a required time management unit of the traffic status estimation device according to the second example embodiment of the present invention.

In this case, FIG. 11 is a diagram illustrating a time required for movement in each section (link movement) in the time zone $T_0$, including the value estimated by the required time management unit 130. Each figure indicated near each arrow in FIG. 11 indicates a time required for movement in each road section. As illustrated in FIG. 11, for example, it is assumed that the required time from the section B to the section C is "one hour". This indicates that a vehicle group present in the section B reaches the section C after one hour, i.e., that an influence on the section C after one hour is highest.

In such a way as to reflect the influence between nodes in consideration of the required time as described above, the time-space topology calculation unit 141 updates the time-space topology based on the estimated required time.

Figure 12:
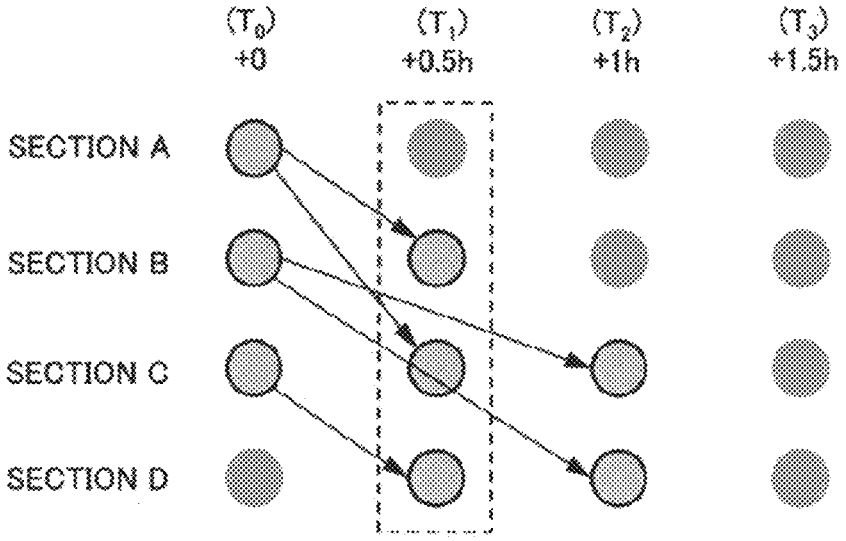
FIG. 12 is a diagram illustrating time-space topology update results based on the required time estimated by the required time management unit of the traffic status estimation device according to the second example embodiment of the present invention.

FIG. 12 is a diagram illustrating the result of updating the time-space topology based on the required time estimated for the time zone $T_0$. In the initial topology, as illustrated in FIG. 5B, each node is connected to all nodes after 30 minutes which are adjacent nodes in the road topology. As illustrated in FIG. 11, since the required time for reaching the section C from the section B, and the required time for reaching the section D from the section B are each one hour, in FIG. 12, the time-space topology is updated in such a manner that the section C and the section D after one hour are each connected from the section B.

Subsequently, the time-space topology calculation unit 141 updates the initial topology based on the required time estimated for each of time zones $T_1$, $T_2$, . . . .

Figure 13:
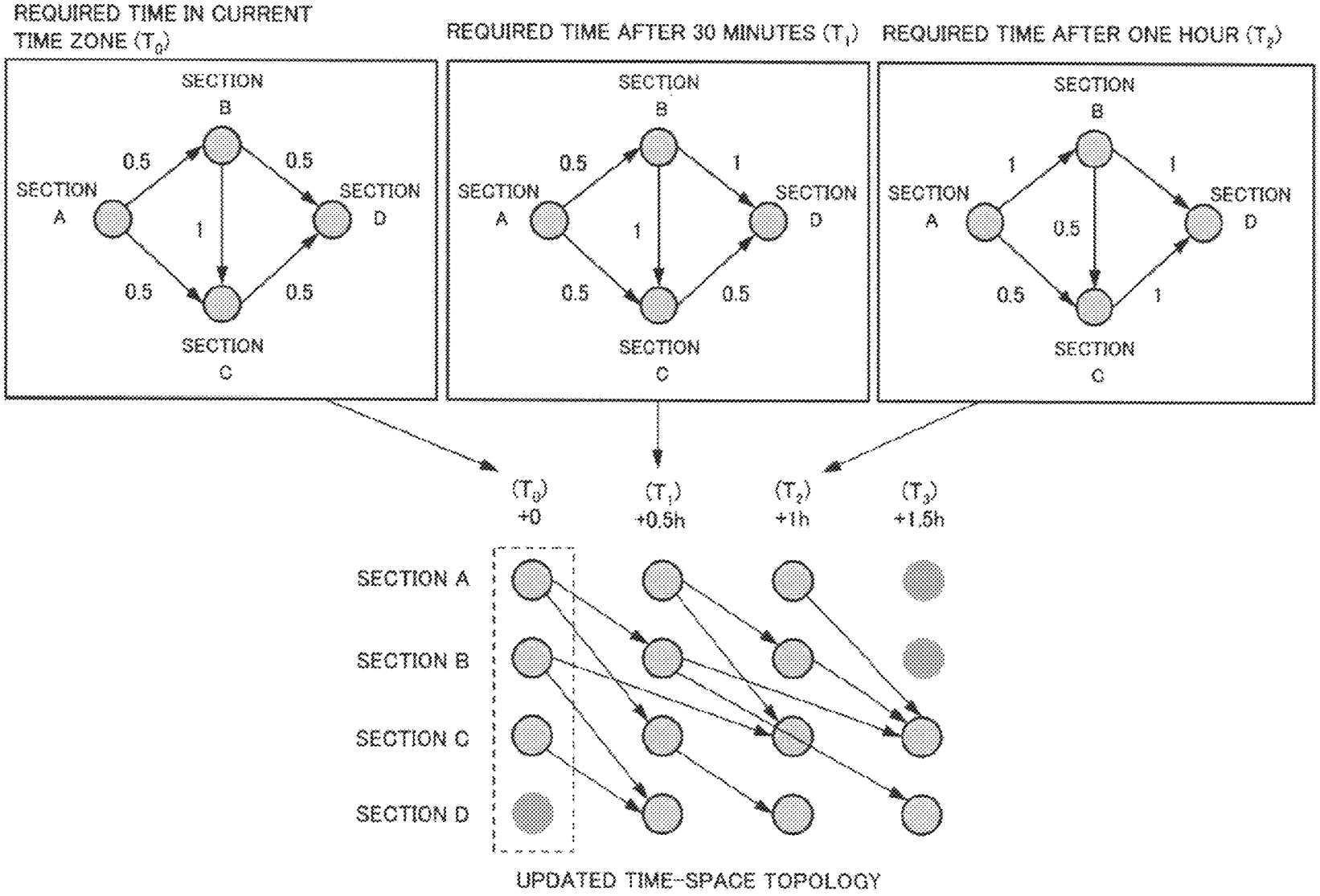
FIG. 13 is a diagram illustrating that the connection relationship is updated based on the required time estimated in each time zone for an initial topology.

FIG. 13 is a diagram illustrating that the connection relationship is updated based on the required time estimated for each time zone with respect to the initial topology illustrated in FIG. 5C. In the diagram illustrating the required time in the current time zone ($T_0$) in FIG. 13, the required time from the section B to the section C is "one hour". Accordingly, the updated time-space topology in FIG. 13 is updated in such a manner that the section B at $T_0$ and the section C at $T_2$ are connected.

In the diagram illustrating the required time after 30 minutes ($T_1$) in FIG. 13, the required time from the section B to the section C and the required time from the section B to the section D are each "one hour". Accordingly, the updated time-space topology illustrated in FIG. 13 is updated in such a manner that the section B at $T_1$ is connected to the section C at $T_3$ and the section B at $T_1$ is connected to the section D at $T_3$.

Further, in the diagram illustrating the required time after one hour ($T_2$) in FIG. 13, the required time from the section A to the section B, the required time from the section B to the section D, and the required time from the section C to the section D are each "one hour", and the required time from the section A to the section C and the required time from the section B to the section C are each "0.5 hours". Therefore, in the updated time-space topology illustrated in FIG. 13, the section A at $T_2$ and the section C at $T_3$ are connected and the section B at $T_2$ and the section C at $T_3$ are connected. Although the illustration for $T_4$ is omitted in FIG. 13, the section A at $T_2$ and the section B at $T_4$ are connected, the section B at $T_2$ and the section D at $T_4$ are connected, and the section C at $T_2$ and the section D at $T_4$ are connected.

Thus, the time-space topology calculation unit 141 updates the initial topology based on the required time estimated for each of all time zones.

By the updating processing as described above, the time-space topology that is close to the actual traffic flow transition can be calculated. The time-space topology calculation unit 141 stores the updated time-space topology in the time-space topology storage unit 143.

After updating the time-space topology as described above, the time-space topology calculation unit 141 instructs the time-space similarity calculation unit 142 to update the time-space similarity. The time-space similarity calculation unit 142 updates the time-space similarity, based on the time-space topology updated by the time-space topology calculation unit 141 in response to the instruction described above.

FIG. 14 is a diagram illustrating an adjacency matrix A updated based on the updated time-space topology illustrated in FIG. 13. The adjacency matrix A is updated based on the updated time-space topology in FIG. 13. In FIG. 14, the element "1" in the row of $T_0$B and in the column of $T_1$C illustrated in FIG. 6 is updated with "0" and the element "0" in the row of $T_0$B and the column of $T_2$C is updated with "1".

The time-space similarity calculation unit 142 updates the degree matrix D based on the adjacency matrix A updated as described above. Further, the time-space similarity calculation unit 142 updates the similarity matrix K, based on the updated adjacency matrix A and degree matrix D. The similarity matrix K is updated based on the equation (1) or (3) described above by using the updated adjacency matrix A and degree matrix D.

The time-space similarity calculation unit 142 updates the degree matrix D based on the updated time-space topology in a similar manner. Further, the time-space similarity calculation unit 142 calculates the time-space similarity by using the updated adjacency matrix A and degree matrix D in a procedure similar to that described above, thereby updating the time-space similarity.

After updating of the time-space similarity as described above is completed, the time-space similarity calculation unit 142 instructs the sensor information management unit 150 to estimate sensor information.

The sensor information management unit 150 performs estimation of sensor information in response to the instruction described above, i.e., estimation of a traffic flow illustrated in the steps S106 and S107 of FIG. 3 and estimation of a vehicle density, based on the time-space similarity updated as described above.

The estimation of the sensor information will be described below. The sensor information management unit 150 estimates the sensor information in such a manner that the traffic flow and the vehicle density in each road section in each time zone in which sensor information is not acquired are complemented by using the time-space similarity updated as described above. Specifically, the flow estimation unit 151 estimates the traffic flow and the density estimation unit 152 estimates the density.

The flow estimation unit 151 estimates the traffic flow and the density by the following expression (5).

$$\min_{w}(\|W_{\Omega} - X_{\Omega}\|^2 + \lambda W^T K W) \tag{5}$$

Here, "W" represents a vector which has an estimated traffic flow or vehicle density as an element and has a length of (the number of time zones× the number of road sections). $W_{\Omega}$ represents a vector in which an element of the road section in which a sensor is installed is extracted from W, and $X_{\Omega}$ represents a vector which has only the traffic flow or vehicle density observed by the sensor as an element and has a length of (the number of sensors× the number of time zones).

FIG. 15A is a diagram illustrating an example of a traffic flow (an observed value) $X_{\Omega}$ in a road section in which a sensor is installed. As illustrated in FIG. 15A, the traffic flow (observed value) $X_{\Omega}$ has, as elements, traffic flows (observed values) $X_{\Omega 1}$, $X_{\Omega 2}$, . . . in each time zone in the road sections (sections B and D in this case) in which the sensor is installed.

FIG. 15B is a diagram illustrating an example of a traffic flow (an estimate value) $W_{\Omega}$ in the road section in which the sensor is installed. As illustrated in FIG. 15B, traffic flows (estimate values) $W_{\Omega 1}$, $W_{\Omega 2}$, . . . in each time zone in the road sections (sections B and D in this case) in which the sensor is installed are estimated by the expression (5).

FIG. 15C illustrates an example of a traffic flow (an estimate value) W. As illustrated in FIG. 15C, traffic flows (estimate values) $W_1$, $W_2$, . . . in each road section in each time zone are estimated by the expression (5).

"K" represents the similarity matrix K described above. The same similarity matrix K may be used for estimation of the traffic flow and estimation of the vehicle density.

The flow estimation unit 151 and the density estimation unit 152 search for W, which is a minimum value, in the expression (5) by using the mathematical optimization method. As the mathematical optimization method, specifically, for example, the internal point method can be used. By minimizing the expression (5), the traffic flow or the vehicle density in each road section in each time zone can be estimated.

The first term in the expression (5) is a term that minimizes a difference between the observed value and the estimate value by focusing only on the section in which the sensor is installed. In other words, in a section in which the observed value is acquired, the estimate value can be acquired in such a way as to approach the value. The second term indicates that the difference in the element of W between nodes having a high time-space similarity is minimized based on the similarity matrix K, like in the expression (4). In other words, W is estimated in such a manner that the difference between the elements of W is minimized, based on an assumption that nodes having a high time-space similarity take close elements of W.

The flow estimation unit 151 can estimate a flow in the unobserved section based on the flow in the observed section in consideration of the time required for movement in each road section by calculation using the expression (5) described above. Similarly, the density estimation unit 152 can estimate a density in the unobserved section, based on the density in the observed section. The flow estimation unit 151 and the density estimation unit 152 may separately estimate the flow and the density, or may simultaneously estimate the flow and the density.

The flow estimation unit 151 and the density estimation unit 152 stores the traffic flow and the density in each road section in each time zone, including the estimated traffic flow and the estimated density, in the traffic information storage unit 153. As described above, the sensor information management unit 150 estimates a traffic status in an unobserved road section, based on the traffic status observed by a GPS or a sensor.

When the above-described estimation is completed, the sensor information management unit 150 instructs the display control unit 160 to display the traffic status. Note that the display timing is not limited to a timing in response to the instruction from the sensor information management unit 150, but instead may be any timing after the estimation described above is completed.

The display control unit 160 displays the traffic status illustrated in the step S108 of FIG. 3 in response to the instruction described above. The display control unit 160 displays the traffic status stored in the traffic information storage unit 153 on the output device 170.

Figure 16:
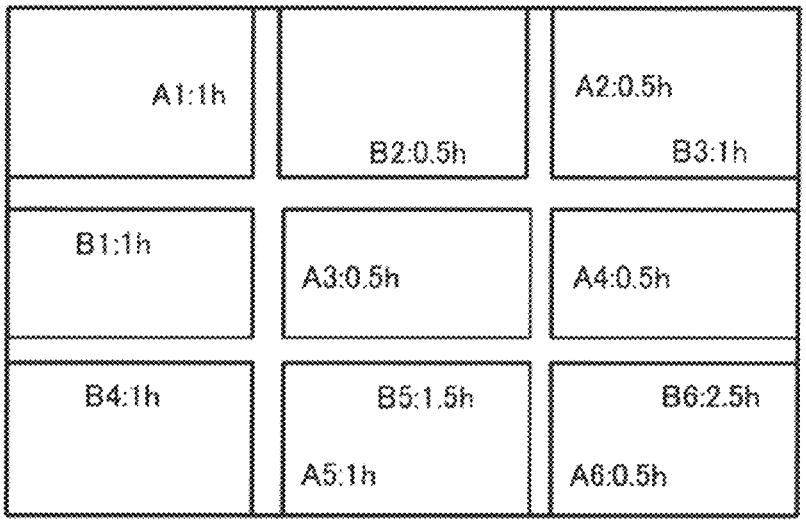
FIG. 16 is a diagram illustrating an example of display of a traffic status by the traffic status estimation device according to the second example embodiment of the present invention.
Figure 16:
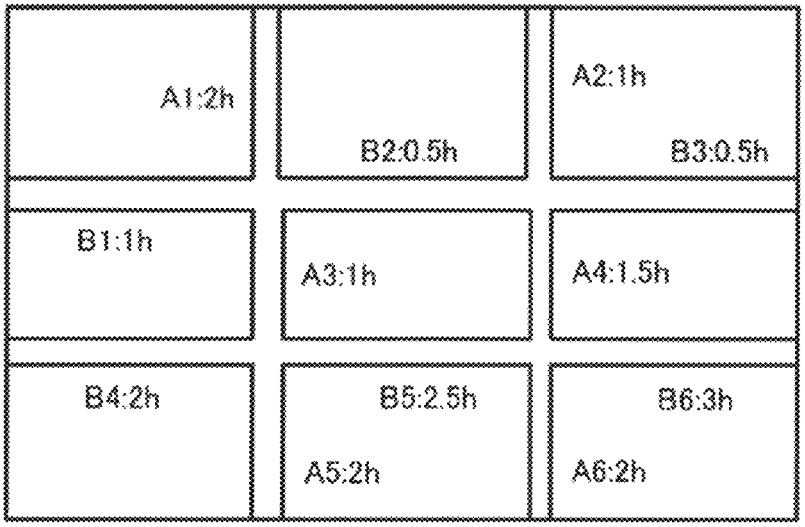

FIG. 16 is a diagram illustrating an example of the display of the traffic status according to this example embodiment. As illustrated in FIG. 16, the display control unit 160 may display, for example, the required time in each road section in each time zone by using the required time f estimated as described above.

FIG. 16 illustrates display of a map in each time zone in which the estimated required time for movement in each road section is added in the vicinity of the road section. Each of "A1", "A2", . . . in FIG. 16 indicates an identifier of each road section, and each of "1h", "0.5h", . . . indicates the required time in the road section. FIG. 16 also illustrates a map including a time required for movement in each road section in each of the time zones $T_0$ and $T_1$.

The display control unit 160 may simultaneously display maps in a plurality of time zones as illustrated in FIG. 16, or may sequentially display maps in a plurality of time zones in response to a predetermined operation such as clicking of a mouse or operation of a track ball. The display control unit 160 may display the required time in each route from a certain point to another point.

Figure 17:
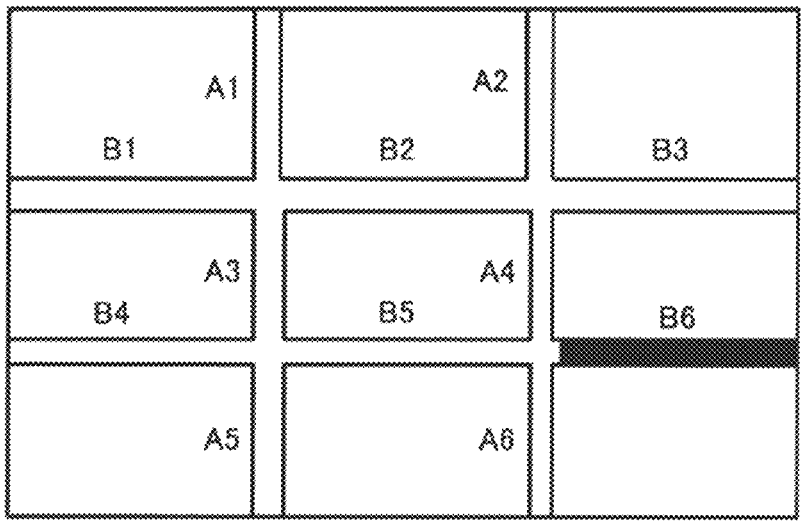
FIG. 17 is a diagram illustrating another example of display of the traffic status by the traffic status estimation device according to the second example embodiment of the present invention.
Figure 17:
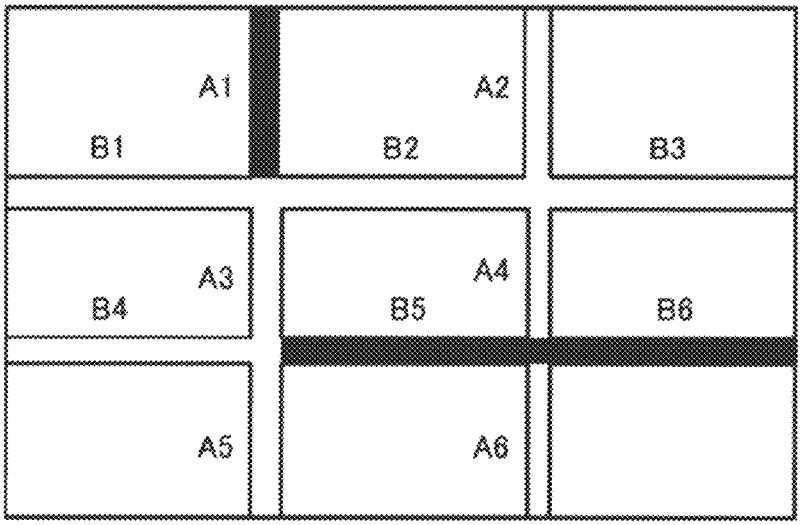

FIG. 17 is a diagram illustrating another example of the display of the traffic status according to this example embodiment. In FIG. 17, a map in which a road section, which is estimated that a traffic jam can occur, is depicted in, for example, a dark color in such a way that the road section can be recognized is displayed in each time zone. Occurrence of a traffic jam is determined based on, for example, the required time in each section and the vehicle speed calculated based on the required time and the distance of the section, which are stored in the traffic information storage unit 153. Alternatively, the occurrence of a traffic jam may be determined based on the traffic flow and the vehicle density which are stored in the traffic information storage unit 153.

The display control unit 160 may display a map in which any information, such as the required time, the vehicle speed, the traffic flow, or the vehicle density, is indicated for each of any section.

As described above, according to this example embodiment, the traffic status estimation device 100 estimates the required time in road sections including a road section in which no vehicle travels, based on the travel history of the vehicle and the time-space similarity of the traffic status in each road section in the required time management unit 130. The sensor information management unit 150 estimates the traffic status in the road section in which no sensor is installed, based on the estimated required time and the traffic status acquired by the sensor.

By employing the configuration described above, according to this example embodiment, it is possible to obtain an advantageous effect that the traffic status can be estimated with high accuracy even in a status where the number of road sections in which a sensor is installed is small and a vehicle travel history is not sufficient.

Note that the GPS information stored in the GPS information storage unit 121 is not limited to the information acquired based on the observation result from the GPS, as long as the information is a travel history indicating in which section in which time zone the vehicle has traveled. For example, a result of tracking the vehicle by using a Media Access Control (MAC) address of an on-vehicle device may be acquired, or a travel history may be acquired from a communication terminal mounted on the vehicle via Bluetooth (registered mark). Alternatively, the information may be acquired from information input to a communication terminal by a user, or information indicating a point and time may be acquired from the user by some means.

Figure 18:
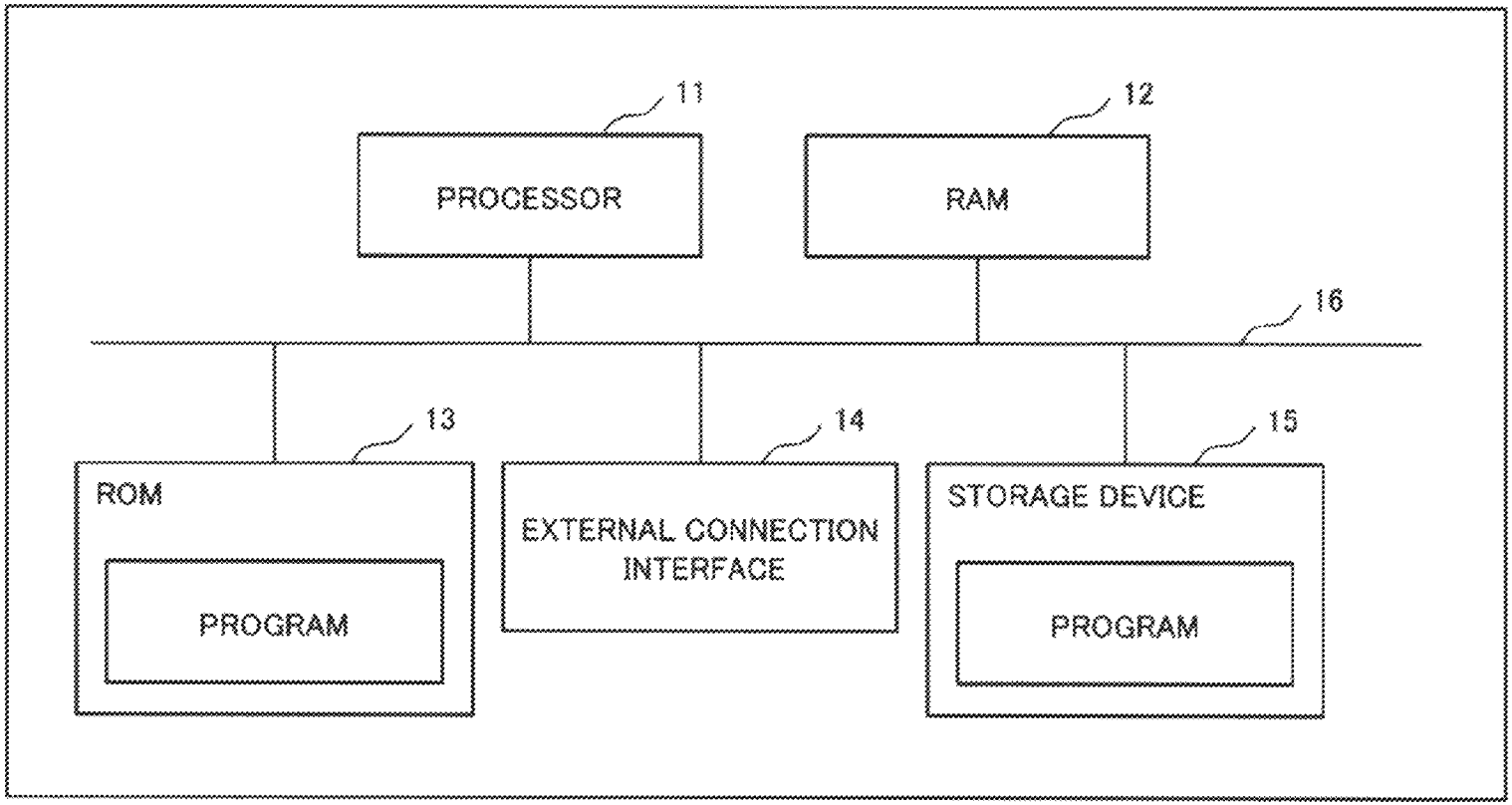
FIG. 18 is a diagram illustrating an example of a hardware configuration for implementing a device described in each example embodiment.

Note that each unit in the device illustrated in FIG. 1 or the like is implemented by hardware resources illustrated in FIG. 18. Specifically, the configuration illustrated in FIG. 18 includes a processor 11, a Random Access Memory (RAM) 12, a Read Only Memory (ROM) 13, an external connection interface 14, a recording device 15, and a bus 16 that connects the components to each other.

As an example executed by the processor 11 illustrated in FIG. 18, each example embodiment described above illustrates a case where a computer program capable of implementing the above-described functions is supplied to a device, and then the processor 11 reads out the computer program into the RAM 12 and executes the computer program, to thereby implement the functions. However, some or all of the functions of each block illustrated in the figures described above may be implemented as hardware.

The supplied computer program may be stored in a computer-readable storage device, such as a readable/writable memory (temporary storage medium) or a hard disk device. In this case, it can be recognized that the present invention is configured by using a code representing the computer program, or a storage medium storing the computer program.

Further, some or all of the components of each device are implemented by a general-purpose or dedicated circuitry, a processor or a combination thereof. These may be configured by using a single chip, or may be configured by using a plurality of chips connected through a bus. Some or all of the components of each device may also be implemented by a combination of the above-described circuitry or the like and a program.

When some or all of the components of each device are implemented by a plurality of information processing devices, circuitry, the plurality of information processing devices, circuitry may be arranged in a centralized manner or a distributed manner. For example, the information processing devices, circuitry may be implemented as a mode in which each connection is made via a communication network, such as a client-and-server system or a cloud computing system.

The present invention has been described above with reference to example embodiments described above. However, the present invention is not limited to the example embodiments described above. In other words, various modes of the present invention, such as various combinations and selections of various disclosure elements described above, which can be understood by those skilled in the art, can be applied within the scope of the present invention.

This application is based upon and claims the benefit of priority from Japanese patent application No. 2016-232881, filed on Nov. 30, 2016, the disclosure of which is incorporated herein in its entirety by reference.

REFERENCE SIGNS LIST

11 Processor
12 RAM
13 ROM
14 External connection interface
15 Recording device
16 Bus
1, 100 Traffic status estimation device
2 Traffic status estimation unit
3 Output unit
110 Information collecting unit
120 Information storage unit
121 GPS information storage unit
122 Road information storage unit
123 Sensor information storage unit
130 Required time management unit
131 Required time estimation unit
132 Required time storage unit
140 Time-space topology management unit
141 Time-space topology calculation unit
142 Time-space similarity calculation unit
143 Time-space topology storage unit
144 Time-space similarity storage unit
150 Sensor information management unit
151 Flow estimation unit
152 Density estimation unit
153 Traffic information storage unit
160 Display control unit
170 Output device

What is claimed is:

1. A traffic status estimation device comprising one or more memories storing instructions and one or more processors configured to execute the instructions to:

estimate a time required for movement in each of a plurality of sections including a section in which a sensor is installed and a section in which a sensor is not installed, in each of a plurality of time zones, based on a value of a similarity, in a traffic status between pairs of each of the plurality of time zones and each of the plurality of sections, and a travel history of a vehicle related to each of the plurality of sections and each of the plurality of time zones;

update the value of the similarity, based on the estimated time;

estimate a traffic status in the section in which the sensor is not installed, based on a traffic status in the section in which the sensor is installed and the updated value of the similarity; and output the estimated traffic status.

2. The traffic status estimation device according to claim 1, wherein wherein the plurality of sections includes a certain section and another section, wherein the plurality of time zones includes a certain time zone and another time zone, and wherein the one or more processors are configured to execute the instructions to estimate the traffic status in such a way that the traffic status in the certain section in the certain time zone and the traffic status in the another section in the another time zone approach closer as the value of the similarity between the traffic status in the certain section in the certain time zone and the traffic status in the another section in the another time zone increases.

3. The traffic status estimation device according to claim 1, wherein the plurality of sections includes a certain section and another section, wherein the plurality of time zones includes a certain time zone and another time zone, and wherein the one or more processors are configured to execute the instructions to estimate a time in such a way that the traffic status in the certain section in the certain time zone and the time required for the movement in the another section in the another time zone approach closer as the value of the similarity between the traffic status in the certain section in the certain time zone and the traffic status in the another section in the another time zone increases.

4. The traffic status estimation device according to claim 1, wherein the plurality of sections includes a certain section and another section, wherein the plurality of time zones includes a certain time zone and another time zone, and wherein the value of the similarity is calculated based on a graph structure which represents the certain time zone in the certain section is related to which the another time zone in the another section.

5. The traffic status estimation device according to claim 4, wherein an initial state of the graph structure is calculated based on an adjacency relationship between the plurality of sections.

6. The traffic status estimation device according to claim 5, wherein the one or more processors are configured to execute the instructions to update the graph structure, based on the estimated time, and updates the value of the similarity, based on the updated graph structure.

7. A traffic status estimation method comprising:

estimating a time required to movement in each of a plurality of sections including a section in which a sensor is installed and a section in which a sensor is not installed, in each of a plurality of time zones, based on a value of a similarity, in a traffic status between pairs of each of the plurality of time zones and each of the plurality of sections, and a travel history of a vehicle related to each of the plurality of sections and each of the plurality of time zones;

updating the value of the similarity, based on the estimated time;

estimating a traffic status in the section in which the sensor is not installed, based on a traffic status in the section in which the sensor is installed and the updated value of the similarity; and outputting the estimated traffic status.

8. A non-transitory computer readable recording medium storing a program that causes a computer to execute processing of:

estimating a time required for movement in each of a plurality of sections including a section in which a sensor is installed and a section in which a sensor is not installed, in each of a plurality of time zones, based on a value of a similarity, in a traffic status between pairs of each of the plurality of time zones and each of the plurality of sections, and a travel history of a vehicle related to each of the plurality of sections and each of the plurality of time zones;

updating the value of the similarity, based on the estimated time;

estimating a traffic status in the section in which the sensor is not installed, based on a traffic status in the section in which the sensor is installed and the updated value of the similarity; and outputting the estimated traffic status.

9. The traffic status estimation device according to claim 2, wherein the value of the similarity is calculated based on a graph structure which represents the certain time zone in the certain section is related to which the another time zone in the another section.

10. The traffic status estimation device according to claim 3, wherein the value of the similarity is calculated based on a graph structure which represents the certain time zone in the certain section is related to which the another time zone in the another section.

* * * * *